US005259276A

United States Patent [19]

Baron

[11] Patent Number: 5,259,276

[45] Date of Patent: Nov. 9, 1993

[54] RATCHET WRENCH INCLUDING TOOTHLESS DRIVE

[76] Inventor: George A. Baron, 4115 Junker, Rosenberg, Tex. 77471

[21] Appl. No.: 937,129

[22] Filed: Aug. 31, 1992

[51] Int. Cl.[5] ..... B25B 13/00

[52] U.S. Cl. ..... 81/58.2; 81/59.1; 81/63.1

[58] Field of Search ..... 81/58, 58.2, 59.1, 60, 81/63.1

[56] References Cited

U.S. PATENT DOCUMENTS

| | | | |
|---|---|---|---|
| 2,551,669 | 5/1951 | Hale | 81/58.2 |
| 2,699,082 | 1/1955 | Viets | 81/58.2 |
| 2,766,648 | 10/1956 | Jazwieck | 81/58 |
| 3,640,158 | 2/1972 | Myers | 81/59.1 X |
| 3,823,625 | 7/1974 | Myers | 81/59.1 |
| 4,928,558 | 5/1990 | Makhlouf | 81/58.2 X |

FOREIGN PATENT DOCUMENTS

| | | | |
|---|---|---|---|
| 407415 | 2/1910 | France | 81/58 |

*Primary Examiner*—James G. Smith

[57] ABSTRACT

A ratchet wrench mechanism is set forth. It is constructed so that it advances on rotation in one direction and locks when attempting to rotate the ratchet in the opposite direction. It does not require incremental advances as occur with a toothed locking mechanism in the ratchet. Rather, the handle supports a socket which has a surrounding shoulder with upper and lower faces. The socket and shoulder have a gap to permit socket insertion over a bolt. The shoulder passes through wedge shaped chambers or cavities in the housing, and wedges loaded by a bias spring are forced towards the narrow end of the tapered chambers. Rotation in one direction is permitted because the wedges are retracted to the large end of the cavity, but rotation in the opposite direction is forbidden when the wedges move to the opposite and narrow end of the cavity.

21 Claims, 2 Drawing Sheets

FIG. 4
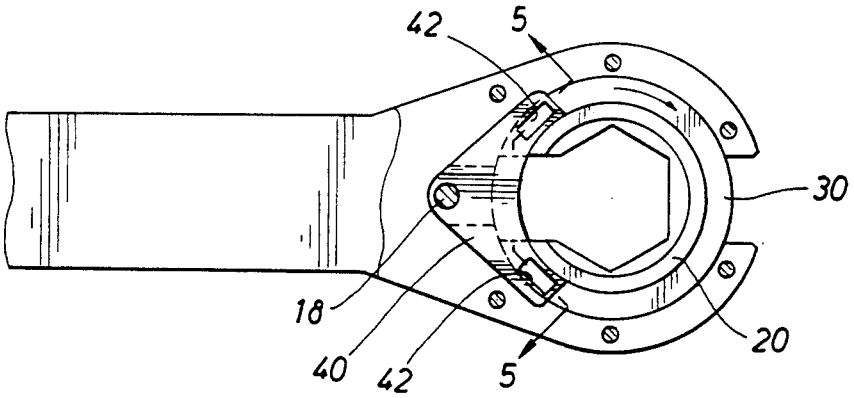
FIG. 5
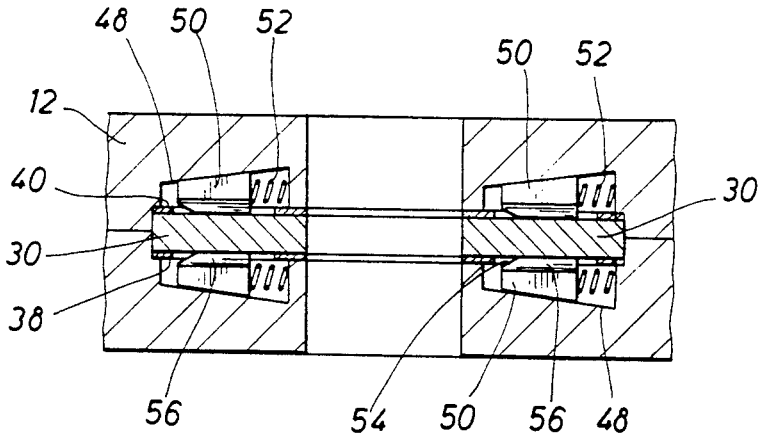
FIG. 6
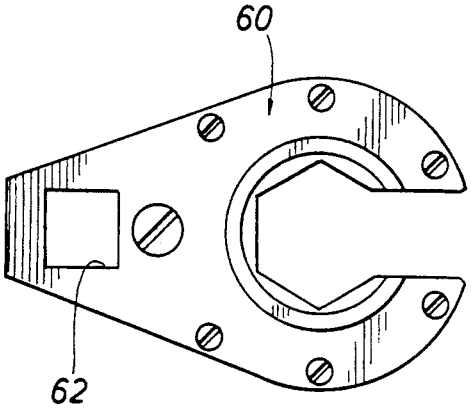
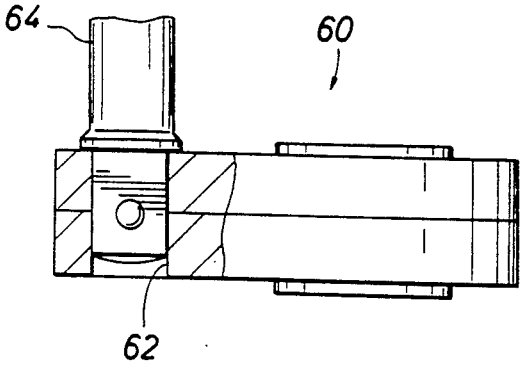
FIG. 7

RATCHET WRENCH INCLUDING TOOTHLESS DRIVE

BACKGROUND OF THE DISCLOSURE

The present disclosure is directed to a ratchet wrench mechanism, and one which is different in operation in that it does not include a ratchet mechanism which advances by a finite measure. This structure incorporates a toothless drive which thereby enables rotation by an infinitely varied amount.

In the use of hand tools, there is a well appreciated need for ratchet type mechanisms. Indeed, ratchets in conjunction with socket drives are used by practically all machinist and repair personnel. As a generalization such devices are extremely handy for service work. There is however a limitation at times arising from the physical locale where the socket connection is somewhat constrained. Sometimes, rather than use a socket connected with a ratchet, the only choice which is permitted by the circumstances of use is to engage a nut or bolt with an open end wrench. Non-adjustable box and open end wrenches are normally available for this purpose. Especially with an open end wrench, a nut can be engaged from the side without having to slip the wrench over the head. This type of motion permits one to engage the bolt head or nut on the bolt laterally. Sometimes, that is the only access which is permitted.

One of the difficulties with use of a ratchet wrench is the fixed incremental movement. The fixed increment of travel is determined by the spacing of the teeth involved in the ratchet mechanism. These teeth are normally arranged in a regular spacing. Since the device moves a catch mechanism from the first tooth to the next tooth, each advance of the ratchet requires a finite advance. In other words, the ratchet mechanism must drive the socket through a fixed angle of rotation, or some multiple thereof. If it is convenient, the handle can be moved so far that several incremental steps are achieved during the ratchet advance. If it is not handy or if the external working space is constrained, then difficulties arise in this regard. As will be understood, if the arcuate motion of the user is constrained by half, then tightening requires twice as many ratcheting movements to achieve the same amount of wrench transferred rotation.

The foregoing is especially true in a system which utilizes a wrench which has a fixed step or lead in the ratchet mechanism. Briefly, that describes those devices which are in popular fashion nowadays. Such a device is exemplified by the disclosure in U.S. Pat. No. 3,204,496. Briefly, this patent is directed to a ratchet mechanism which uses a spring loaded FIG. 8 shaped tooth caught in a raceway on the exterior of a socket and on the interior of a housing. In U.S. Pat. No. 3,398,612 a ratchet mechanism is shown which has spheres captured in a raceway, the raceway having one wall which is a cylinder and another wall which has an undulating surface which creates a wedge shaped cavity. It is a sphere related ratchet mechanism.

Another structure is shown in U.S. Pat. No. 4,491,043 illustrating a number of different embodiments which utilize a sphere which moves into a locking or unlocking position in conjunction with a tapered cavity. Last of all U.S. Pat. No. 3,590,667 sets forth a roller as opposed to a sphere, and the roller is captured in a tapered chamber.

The device of the present disclosure can be readily distinguished from the structures described above in the four specific references noted. The present apparatus utilizes a socket of conventional six sided construction but one which omits one side so that it functions as an open end wrench or socket. The structure further utilizes a surrounding, external, centered rib, halfway between the top and bottom, which rib provides a working surface on the top and bottom. The rib is incorporated to support, in frictional sliding engagement, two pair of opposing wedges. One pair of wedges is located above the rib and another is located below the rib. Each of the wedges is caught in an internal cavity which has a tapered surface positioned to drive the wedge frictionally into contact with the surrounding rib around the socket. This movement by a pair of opposing wedges provides a clamping action, thereby preventing further movement. On the clamping action, the wedges prevent further rib socket rotation and assist in locking the socket against rotation. In summary, the locking action occurs when the ratchet mechanism is rotated in the direction resulting in wedge latching, and that can occur after any amount of angular rotation in the opposite direction. That might occur anytime when the user operates the device in the opposite direction to achieve latching. The incremental movement is not a fixed angle of rotation as occurs with a tooth equipped ratchet mechanism.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 4 is a view similar to FIG. 3 with a portion of the top plate broken away to show the guide plate in conjunction with a spacer plate as will be understood on comparing FIGS. 3 and 4, and FIG. 4 further shows rotation of the socket;

FIG. 5 is a sectional view along the line 5—5 of FIG. 4 through the wrench head showing the wedge shaped locking mechanism;

FIG. 6 is a plan view of a socket mounted ratchet head in accordance with the present disclosure; and FIG. 7 is a sectional view of the ratchet head shown in FIG. 6 showing a connection with a socket drive.

DETAILED DESCRIPTION OF THE PREFERRED EMBODIMENT

Figure 1:
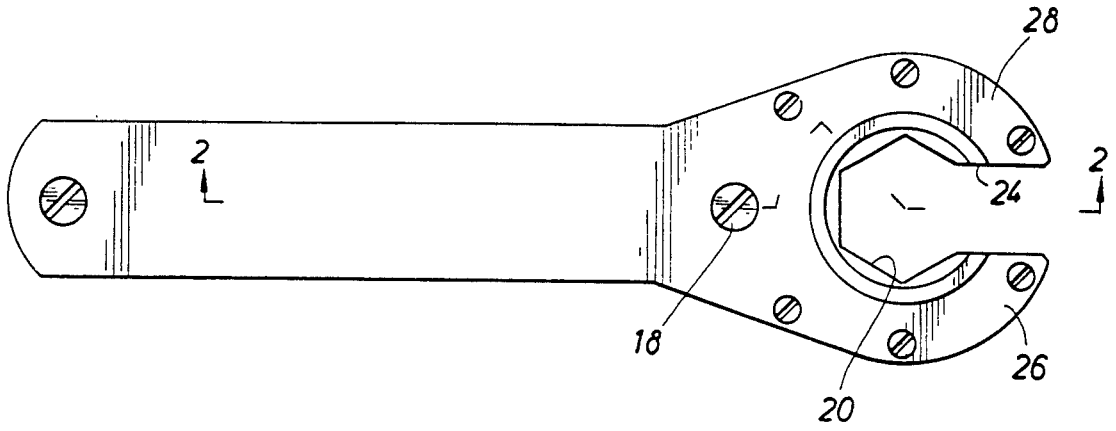
FIG. 1 is a plan view of a ratchet mechanism in accordance with the present disclosure which incorporates a socket having an open side.
Figure 2:
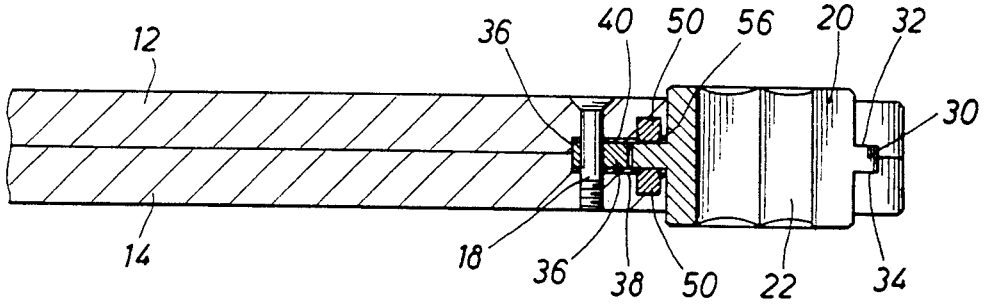
FIG. 2 is a sectional view along the line 2—2 of FIG. 1 showing details of construction of the head of the wrench which supports a socket.

Attention is now directed to FIG. 1 of the drawings where the numeral 10 identifies a ratchet wrench in accordance with the present disclosure. While many details will be set forth, one of the features of this ratchet wrench is the fact that it includes a head which provides a ratchet type motion. Nevertheless, in the forward direction, the motion is not incremental. The stroke in the forward direction can be as short or as long as required. For this purpose, the disclosure will focus on FIGS. 1 and 2 considered jointly for the moment, and then details of construction will be given thereafter. Briefly, the apparatus includes upper and lower handle plates 12 and 14 which are joined together by suitable fasteners 16 and 18. These have the form of fastening bolts with tapered heads, and the handle plates 12 and 14 are provided with counter sunk openings to thereby permit fastening. Moreover, the two handle portions terminate in a circular housing which is constructed so that it encircles approximately 300° of a socket 20 which is captured in the housing. The socket 20 has sufficient height as shown in FIG. 2 so that the internal flats 22 are able to grasp the head of a bolt or a mating nut for the bolt. In particular, six flats are normally required on a bolt head in accordance with industry standards, and the socket has socket flats deployed to mate with the six flats on the bolt head. The socket however is open at one side, there being a gap 24 in the socket where one of the six flats has been omitted. This defines a gap 24 in the socket which is sufficient in width to enable the socket to slide over a bolt, and then move upwardly or downwardly as required to come into engagement with the flats on the bolt head. As will be further understood, the six flats on the interior of the socket 20 are equal to each other in width and height. The flats are enabled for grasping of the bolt head or nut. Even so, the omission of one socket flat permits the socket to slide engage the bolt stem from the side, thereby enhancing the facility in which the device is used. The socket is permanently captured in the wrench head by the encircling arms 26 and 28. The arms 26 and 28, if extended, would then define a full circle construction supporting the socket. The gap that is constructed in the socket is repeated in the wrench head so that the encircling arms 26 and 28 form an opposing support housing for structural integrity while opening at the gap to enable the bolt shaft to slide into the head and socket.

The socket is constructed with a surrounding peripheral shoulder 30. The encircling shoulder 30 is defined by a pair of parallel, outwardly facing surfaces 32 and 34. The surfaces 32 and 34 serve as locking surfaces to lock the socket. Before locking does occur, the surrounding shoulder with the surfaces 32 and 34 serves as a guide mechanism which assures that the socket remains engaged with the handle during rotation. As will be observed in FIG. 2 of the drawings, the two halves which define the handle are undercut to thereby define a circular undercut cavity sized to receive the protruding shoulder 30 so that rotation is permitted. Further, rotation is assured with minimum friction because the protruding shoulder 30 has modest clearance on all faces so that the socket 20 can rotate substantially without drag. While the socket may fit snugly against the handle, modest clearance is provided so that rotation can be readily obtained.

Figure 3:
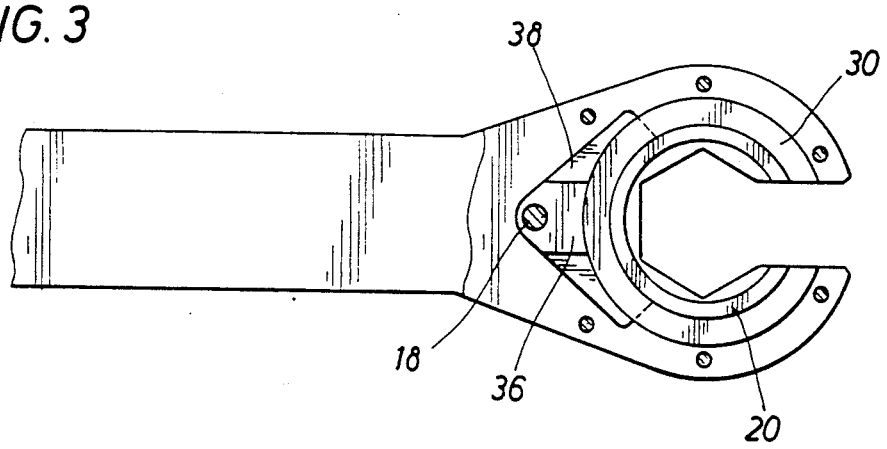
FIG. 3 is a view of the head of the socket wrench with a portion of the top plate broken away to illustrate details of construction of a guide plate.

The cavity just mentioned fits around the protruding shoulder 30. It is also enhanced by defining certain wedge receiving cavities which will be detailed later. Before going to that aspect of the structure, FIG. 3 will be observed to incorporate a portion of the handle broken away. This shows details of construction of the fastener 18 which is positioned in the two portions defining the handle to hold them together. An upstanding spacer 36 is located in the cavity and has a central opening to receive the fastener 18. When in position, the spacer 36 locks a pair of guide plates in spaced position. One guide plate is at one end of the spacer 36 and is identified by the numeral 38. Another guide plate 40 is shown in FIG. 4 and is placed above the spacer 36. The spacer 36 in conjunction with the spaced plates 38 and 40 are held in position by the fastener 18 which passes through these components. The height of the spacer 36 is determined primarily by the thickness of the shoulder 30. This is better shown in FIG. 2 of the drawings. There, the spacer 36 is taller than and located immediately adjacent to the shoulder 30. The guide plates 38 and 40 are formed with rectangular windows 42 better shown in FIG. 4 of the drawings. The windows 42 are included to enable wedges to extend through the guide plate. The guide plate 40 and the symmetrical guide plate 38 are both provided with such windows. Each plate has two windows, thereby providing a total of four windows in the two guide plates 38 and 40. The four windows cooperate with four wedges. The wedges are better shown in FIG. 5 of the drawings. Note that the wedges are located in cavities which conform to the wedges.

Consider this construction in detail. In FIG. 5 of the drawings, one of the wedges will be described and the mode of operation of that particular wedge will be extended to the other wedges. First, the handle portion 12 has an internal cavity with a sloping face 48. The sloping face 48 is sized so that it has a large cavity and a narrow end. A wedge 50 is placed in the cavity. A coil spring 52 urges the wedge 50 toward the opposite end of the cavity. There are limitations on movement of the wedge as a result of the tapering cavity. The wedge has a bottom face which fits through the slot 42 in the guide plate and bears against the opposing face of the shoulder 30. When the coil spring 52 is highly compressed and the wedge is against the coil spring to compress it, there is very little friction between the wedge and shoulder, thereby permitting wrench ratcheting action.

When the wedge is at the narrow end of the cavity which is provided for it, the wedge is jammed against the shoulder 30 and pinches the shoulder, thereby preventing rotation. The action of one wedge cannot be considered in isolation; rather, the wedge shown in FIG. 5 above the shoulder 30 is duplicated by a similar wedge below the shoulder. The two wedges together form a pinching movement, thereby clamping the shoulder 30 and preventing rotation. This pinching movement is sufficient to stop rotation.

Returning momentarily to FIG. 5 of the drawings, it will be observed that the shoulder 30 is clamped or pinched at two locations. The two locations can be seen better in FIG. 4 at the two windows 42 which are in the guide plate 40. Two spaced windows are used because the gap 24 in the socket interrupts the shoulder 30. The shoulder 30 thus is always clamped by one pair of wedges. While the gap might be at one window location or the other, thereby preventing clamping at one or the other of the two pair of wedges, the four wedges comprising two separate sets are spaced sufficiently from each other that the gap 24 may interrupt only one pair of wedges at one time. The provision of two separate sets of wedges at location sufficiently spaced to assure proper clamping enables the system to rotate continuously in one direction and yet prevents socket rotation in the opposite direction without regard to the location of the gap. During rotation, the leading edge of the shoulder 30 is brought into contact with the facing wedges. Note in FIG. 5 of the drawings that the wedges are constructed with an undercut face 54 which enables the wedge to ride over the leading edge of the shoulder 30 and ride up onto the confronting face thereof. Note also that the wedge 50 is shown in FIG. 2 of the drawings where it is also constructed with a tapered face 56 which enables the wedge to insert into the window 42 better shown in FIG. 4 of the drawings. Returning now to FIG. 5, the two pairs of wedges provide a mechanism which controls rotation of the socket.

In FIG. 5 the shoulder 30 is clamped as mentioned to prevent rotation in one direction. This confines operation of the socket to a single direction of rotation. For rotation in the opposite direction, the socket is merely flipped over by the user to get a device which rotates in the opposite direction. Rotation in a particular circumstance for a user thus requires that the mechanism be positioned so that the ratchet mechanism provides the benefit desired by the user. If it is not oriented to help the user, the user merely has to retract the socket from engagement, flip the entire tool 10 over, and then rotate in the opposite direction. In other words, the structure of the socket is limited in the direction of rotation. It can rotate only in one direction, and locks on an attempt to rotate in the opposite direction. Nevertheless, bi-directional operation is obtained from the device by virtue of the fact that is symmetrically constructed, referring to the top and bottom faces of the system. This symmetrical construction enables one to obtain a bilateral device capable of rotation relative to a bolt head or nut. While the device internally permits rotation in only one direction, the device in application works in both directions.

Consider how this tool 10 is implemented by the user. The socket is simply engaged with a nut or bolt head. It is rotated in one direction to either tighten or loosen the nut as required. This rotation involves movement of the socket so that the wedges 50 shown in FIG. 5 are urged against the compressed springs 52, thereby obtaining greater space in the tapered cavities, and being released from the locking position. When the wedges are pushed to the right as viewed in FIG. 5, rotation of the socket is continuous. When however the socket is rotated in the opposite direction, the shoulder 30 moves in a direction causing the wedges 50 to slide towards the narrow end of the cavity provided for the wedges, and clamping occurs. The left hand pair of wedges will provide clamping action and the same is true at the right hand pair. In the event that either pair is disengaged because the gap in the shoulder prevents shoulder contact, clamping still occurs and further rotation is forbidden by only one pair of wedges. It is not necessary for two pair of wedges to be engaged, thereby providing the clamping action noted. When the clamping action occurs, clamping is made complete without requiring rotation through an incremental advance of one tooth as occurs with a ratchet system utilizing a tooth locking mechanism. This locking occurs because there is a frictional wedging action by the wedge 50 in conjunction with the shoulder 30.

Attention is momentarily directed to FIGS. 6 and 7 of the drawings. There, a modified ratchet head 60 is illustrated in the drawings. It is constructed without a handle, but is provided with a square opening 62 which enables an extender bar 64 to be connected therewith. The bar 64 is provided with a square head at the remote end, thereby fixedly engaging the mechanism 60.

The embodiment shown in FIG. 6 and 7 finds use in constrained circumstances. There are times when the ratchet wrench equipped with a handle is simply too long, and in that instance, the embodiment 60 can be used with a conventional extender bar typically found in the tool chest of many mechanics.

While the foregoing is directed to the preferred embodiment, the scope thereof is determined by the claims which follow:

I claim:

1. An open end wrench comprising:

(a) a handle;

(b) a socket having a plurality of flats arranged around an internal socket opening therein wherein the flats cooperate to engage a bolt head or nut constructed in accordance with an industry standard, and wherein said socket is constructed and adapted to rotate the bolt head or nut, and said socket includes a gap enabling the bolt to pass through said gap in alignment of the socket with the bolt head or nut;

(c) an encircling protruding shoulder concentric about said socket and interrupted by said gap;

(d) upper and lower parallel faces on said shoulder encircling said socket;

(e) a housing supported by said handle and encircling said socket sufficiently to hold said socket for rotation relative to said housing without escape from said housing wherein socket rotation is guided by said shoulder; and (f) first means moving between a wedged position against said upper parallel face on said shoulder and a free position wherein said first means in the wedged position locks said socket against rotation in one direction, and said first means permits rotation in the opposite direction, and second means moving between a wedged position against said lower parallel face on said shoulder and a free position wherein said second means in the wedged position locks said socket against rotation in one direction, and said second means permits rotation in the opposite direction.

2. The apparatus of claim 1 wherein said handle terminates in said housing and includes a shoulder conforming cavity for said shoulder.

3. The apparatus of claim 1 including duplicate, spaced apart first means supported by said housing wherein each of said first means engages said faces at a spacing greater than the gap in said socket.

4. The apparatus of claim 3 wherein said first means provides said wedged position on rotation in the same direction.

5. The apparatus of claim 4 wherein said first means comprises:

(a) a wedged-shaped member having a face in contact with one of said faces on said shoulder;

(b) a confining wedge-shaped cavity in said housing having a confining surface wedging said wedge shaped member against said confining surface and also against one of said faces on said shoulder; and (c) resilient means urging said wedge-shaped member against said surface.

6. The apparatus of claim 1 wherein said handle is a pair of joined handle members defining said housing to encircle said socket at least partially thereabout to confine said socket for rotation.

7. The apparatus of claim 6 wherein said socket has a height sufficient to engage the flats of a bolt head or nut, and wherein said shoulder formed on the exterior of said socket circumferentially encircles said socket except at said gap, and said shoulder is guided by a conforming cavity with upper and lower faces around said shoulder.

8. The apparatus of claim 7 including duplicate, spaced apart ratchet means supported by said housing wherein each of said ratchet means engages said surface at a spacing greater than the gap in said socket.

9. The apparatus of claim 8 wherein said ratchet means provide said wedging condition on rotation in the same direction.

10. An open end wrench comprising:

(a) a handle;

(b) a socket having a plurality of flats arranged around an internal socket opening therein wherein the flats cooperate to engage a bolt head or nut constructed in accordance with an industry standard, and wherein said socket is constructed and adapted to rotate the bolt head or nut, and said socket includes a gap enabling the bolt to pass through said gap on alignment of the socket with the bolt head or nut;

(c) an encircling and exposed face concentric about said socket and interrupted by said gap wherein said face is located in a plane at right angles to the axis of rotation of said bolt head or nut;

(d) a housing supported by said handle and encircling said socket sufficiently to hold said socket for rotation relative to said housing without escape from said housing wherein rotation is guided by said face; and (e) wedge shaped means moving between a wedged position against said face and a free position wherein the wedged position locks said face and socket against rotation in one direction, and said wedge shaped means permits rotation in the opposite direction.

11. The apparatus of claim 10 wherein said handle terminates at said housing and includes a conforming cavity for said wedge shaped means.

12. The apparatus of claim 10 including duplicate, spaced apart wedge shaped means supported by said housing wherein each of said wedge shaped means engages said face at a spacing greater than the gap in said socket.

13. The apparatus of claim 10 wherein said wedge shaped means comprises:

(a) a wedged shaped member having a face in contact with said face on said socket;

(b) a confining and shaped cavity in said housing having a confining surface wedging said wedge shaped member against said confining surface and also against said face on said socket; and (c) resilient means urging said wedge shaped member against said confining surface.

14. The apparatus of claim 10 wherein said socket has a height sufficient to engage the flats of a bolt head or nut, and wherein said face of said socket circumferentially encircles said socket except at said gap, and said face is positioned adjacent to a conforming cavity for said wedge shaped means.

15. The apparatus of claim 13 including duplicate, spaced apart wedged shaped means supported by said housing wherein each of said wedge shaped means engages said face at a spacing greater than the gap in said socket.

16. An open end wrench comprising:

(a) a handle;

(b) a socket having a plurality of flats arranged around an internal socket opening therein wherein the flats cooperate to engage a bolt head or nut constructed in accordance with an industry standard, and wherein said socket is constructed and adapted to rotate the bolt head or nut, and said socket includes a gap enabling the bolt to pass through said gap on alignment of the socket with the bolt head or nut;

(c) a housing supported by said handle and encircling said socket sufficiently to capture and hold said socket for rotation relative to said housing without escape from said housing wherein rotation is guided by said housing; and (d) wedge shaped means moving between a wedged position and a free position wherein the wedged position locks said socket against rotation in one direction, and said wedge shaped means permits rotation in the opposite direction; and (e) an encircling gripping surface concentric about said socket and interrupted by said gap wherein said surface is located to cooperatively grip said wedge shaped means for controlling rotation and said surface is toothless and smooth.

17. The apparatus of claim 16 wherein said handle terminates at said housing and includes a conforming cavity for said wedge shaped means.

18. The apparatus of claim 16 including duplicate, spaced apart wedge shaped means supporting by said housing wherein each of said wedge shaped means engages gripping surface at a spacing greater than the gap in said socket.

19. The apparatus of claim 16 wherein said wedge shaped means comprises:

(a) a wedged shaped member having a face in contact with said gripping surface on said socket;

(b) a confining and shaped cavity in said housing having a confining surface wedging said wedge shaped member against said confining surface and also against said gripping surface; and (c) resilient means urging said wedge shaped member against said confining surface.

20. The application of claim 16 wherein the socket has a height sufficient to engage the flats of a bolt head or nut.

21. An open end wrench comprising:

(a) a handle;

(b) a socket having a plurality of flats arranged around an internal socket opening therein wherein the flats cooperate to engage a bolt head or nut constructed with accordance with an industry standard, and wherein said socket is constructed and adapted to rotate the bolt head or nut, and said socket includes a gap enabling the bolt to pass through said gap in alignment of the socket with the bolt head or nut;

(c) an encircling protruding shoulder concentric about said socket and interrupted by said gap;

(d) upper and lower parallel faces on said shoulder encircling said socket;

(e) a housing supported by said handle and encircling said socket sufficiently to hold said socket for rotation relative to said housing without escape from said housing wherein socket rotation is guided by said shoulder; and (f) first means moving between a wedged position against one of said faces on said shoulder and a free position wherein said first means in the wedged position locks said socket against rotation in one direction, and said first means permits rotation in the opposite direction, said first means comprising:

(1) a wedged shaped member having a face in contact with one of said faces on said shoulder;

(2) a confining wedge shaped cavity in said housing having a confining surface wedging said wedge shaped member against said confining surface and also against one of said faces on said shoulder;

(3) resilient means urging said wedge shaped member against said surface, and (4) said first means provides said wedged position on rotation in the same direction.

* * * * *